US008448999B2

(12) United States Patent
Grifoll Sauri et al.

(10) Patent No.: US 8,448,999 B2
(45) Date of Patent: May 28, 2013

(54) MOTOR-DRIVEN LOCK WITH A ROTARY BOLT

(75) Inventors: Joan Grifoll Sauri, Sant Cugat del Valles (ES); Ramon Jalle Diaz, Castellbisbal (ES)

(73) Assignee: Tubsa Automocion, S.L., Sant Just Desvern (ES)

( * ) Notice: Subject to any disclaimer, the term of this patent is extended or adjusted under 35 U.S.C. 154(b) by 586 days.

(21) Appl. No.: 12/550,855

(22) Filed: Aug. 31, 2009

(65) Prior Publication Data

US 2010/0066103 A1 Mar. 18, 2010

(30) Foreign Application Priority Data

Sep. 16, 2008 (ES) ..... 200802623

(51) Int. Cl.
*E05C 3/06* (2006.01)
*E05C 3/16* (2006.01)

(52) U.S. Cl.
USPC ..... 292/201; 292/216; 292/DIG. 23

(58) Field of Classification Search
USPC ..... 292/201, 216, 197, 215, DIG. 23, 292/DIG. 42
See application file for complete search history.

(56) References Cited

U.S. PATENT DOCUMENTS

| | | | | |
|---|---|---|---|---|
| 4,395,064 A | | 7/1983 | Bellot et al. | |
| 4,667,991 A | | 5/1987 | Pebre | |
| 4,905,528 A | * | 3/1990 | Kawaguchi et al. | 74/102 |
| 5,649,726 A | * | 7/1997 | Rogers et al. | 292/201 |
| 5,697,237 A | * | 12/1997 | Dilger et al. | 70/264 |
| 5,746,076 A | * | 5/1998 | Inoue | 70/277 |
| 5,802,894 A | * | 9/1998 | Jahrsetz et al. | 70/264 |
| 5,934,717 A | * | 8/1999 | Wirths et al. | 292/201 |
| 5,938,253 A | * | 8/1999 | Szablewski et al. | 292/216 |
| 6,155,124 A | * | 12/2000 | Wirths | 74/89.13 |
| 6,386,599 B1 | * | 5/2002 | Chevalier | 292/201 |
| 6,416,088 B1 | * | 7/2002 | Graute | 292/216 |
| 6,419,286 B1 | * | 7/2002 | Szablewski | 292/216 |
| 6,439,623 B1 | * | 8/2002 | Lohfeld et al. | 292/201 |
| 6,526,790 B2 | * | 3/2003 | Wegner | 70/277 |
| 6,557,911 B2 | * | 5/2003 | Nelsen et al. | 292/216 |
| 6,565,131 B2 | * | 5/2003 | Roos | 292/201 |

(Continued)

FOREIGN PATENT DOCUMENTS

| | | | |
|---|---|---|---|
| DE | 196 14 123 | A1 | 10/1997 |
| DE | 103 19 952 | A1 | 11/2004 |
| EP | 0 812 972 | A2 | 12/1997 |
| WO | 2008/064234 | A2 | 5/2008 |

OTHER PUBLICATIONS

Spanish Search Report for Spanish Patent Application No. 200802623, dated Jan. 25, 2011.

*Primary Examiner* — Carlos Lugo
(74) *Attorney, Agent, or Firm* — Sughrue Mion, PLLC

(57) ABSTRACT

The invention relates to a motor-driven lock with a rotary bolt, especially for rear doors, hatches or trunks of automotive vehicles, comprising a rotary bolt and a latch, also rotary between a closed position, in which it retains the bolt in a locking position, and another releasing position, in which it releases the mentioned bolt, the lock furthermore comprising a motor-driven drive cam and transmission means, to move the latch from its locking position to its releasing position, comprising a rocker arm, which can swing back and forth between two end positions, provided with a peripheral extension loosely coupled to the end of the latch, and provided with a control slide extending in a curved shape about the axis of rotation of the drive cam.

14 Claims, 4 Drawing Sheets

U.S. PATENT DOCUMENTS

| | | | | |
|---|---|---|---|---|
| 6,575,507 | B2 * | 6/2003 | Reddmann | 292/216 |
| 6,648,380 | B1 * | 11/2003 | Szablewski et al. | 292/201 |
| 6,843,517 | B2 * | 1/2005 | Graute | 292/216 |
| 6,883,839 | B2 * | 4/2005 | Belmond et al. | 292/201 |
| 7,032,937 | B2 * | 4/2006 | Boecker et al. | 292/201 |
| 7,032,938 | B2 * | 4/2006 | Kachouh | 292/201 |
| 7,059,640 | B2 * | 6/2006 | Tensing et al. | 292/201 |
| 7,140,651 | B2 * | 11/2006 | Brose | 292/216 |
| 7,152,890 | B2 * | 12/2006 | Torkowski et al. | 292/216 |
| 7,175,210 | B2 * | 2/2007 | Orzech et al. | 292/216 |
| 7,438,330 | B2 * | 10/2008 | Takahashi | 292/201 |
| 7,766,397 | B2 | 8/2010 | Carabalona | |
| 2002/0070564 | A1 * | 6/2002 | Ohta et al. | 292/201 |
| 2002/0096889 | A1 * | 7/2002 | Nelsen et al. | 292/201 |
| 2004/0245786 | A1 * | 12/2004 | Hashiba et al. | 292/216 |
| 2005/0146144 | A1 | 7/2005 | Brose | |
| 2007/0007774 | A1 * | 1/2007 | Stefanic | 292/216 |
| 2007/0158954 | A1 * | 7/2007 | Warmke et al. | 292/201 |
| 2008/0136196 | A1 * | 6/2008 | Pecoul et al. | 292/215 |

* cited by examiner

MOTOR-DRIVEN LOCK WITH A ROTARY BOLT

TECHNICAL FIELD OF THE INVENTION

The invention relates to a motor-driven lock comprising a rotary bolt and latch, in which the latch is subjected to the action of a spring thrusting it towards the bolt and is suitable for retaining it in a locking position, the lock furthermore comprising a motor-driven drive cam, which rotates about an axis, and transmission means suitable for moving the latch from its retaining position to a releasing position of the bolt.

BACKGROUND OF THE INVENTION

Among the lock devices known and applied to the trunk door/lid of automotive vehicles, there are those in which the latch is driven by means of an electric motor.

A considerable number of this type of lock comprise a wheel coupled to the rotation shaft of the motor and means for the transmission of the rotation movement of said wheel to the latch of the lock for the purpose of moving it from a retaining position of the bolt to a releasing position thereof. For the purpose of being able to move the latch again when the bolt must be released again, the most conventional solution consists of forcing the motor to rotate with no load when the latch is moved by the spring towards the original position, i.e., the position it occupied before the motor is actuated to release the bolt. According to this solution, the transmission means repeat the movements made by the release of the bolt but in the reverse direction. Due to the drawbacks of this solution, including the induced currents when the motor is rotated with no load, the difficulty of adding intermediate locking positions of the bolt or that of completing the mechanisms with means for the manual release of the bolt in the case of emergency, locks in which the motor always rotates in one and the same rotation direction are of particular interest.

By way of example, patent document EP 0812972 describes a motor-driven lock in which a rotary element is driven by a motor with a single rotation direction and is provided with two crank pins symmetrical with respect to its axis of rotation directly driving the latch of the lock. The embodiment variants contemplated in this patent document are not suitable for locks in which, for the sake of space, the shaft of the motor or the transmission means for transmitting the rotation movement are arranged perpendicular to the working plane of the latch and the bolt.

A main objective of the present invention is to disclose a compact lock in which the dynamics of its components allows arranging the output shaft of the motor perpendicular to the action plane of the latch and of the bolt, and in which the drive motor always rotates in one and the same direction.

DISCLOSURE OF THE INVENTION

Essentially, the lock is characterized in that the transmission means comprise a rocker arm, which can swing back and forth between two end positions, provided with a peripheral extension loosely coupled to the end of the latch and provided with a control slide extending in a curved shape about the axis of rotation of the drive cam, with variable radii, at least one grip section with the drive cam being determined, in which the movement of the cam causes the swinging of the rocker arm in a first direction and, by thrusting of its peripheral extension, the rotation of the latch from its closed position to its releasing position and hence that of the bolt to its open position; a first no-load section, in which the drive cam loses contact and rotates without driving the rocker arm, the latter being subjected to the thrust received by the latch which is driven by the second spring and is applied against the bolt; and a stop section, in which resistance to the rotation of the drive cam is offered which is suitable for generating a stop signal of the motor, the contours of the bolt and of the latch, as well as the clearance between the peripheral extension of the rocker arm and the slide of the latch being configured such that, starting from the situation in which the bolt is in the open position, when it is forced to adopt its closed position, for example when the door is closed, when the latch is rotated in a direction towards said bolt by the action of the second spring, the mentioned latch thrusts the peripheral extension of the rocker arm, forcing it to swing in a direction opposite the first direction and to change its position with respect to the drive cam, such that the latter can be driven again, in the same rotation direction and without opposition of the rocker arm, until reaching the grip section of the rocker arm and causing its swinging, producing the rotation of the latch until its releasing position to open the lock.

According to a variant of the invention, the peripheral extension of the rocker arm is inserted with clearance in a groove provided at the end of the latch According to another feature of this variant of the invention, when the bolt adopts its closed position, in the angular movement of the latch about its axis of rotation by the action of the second spring, the portion of the latch provided with the groove moves a length greater than the clearance existing between the peripheral extension of the rocker arm and the mentioned groove.

According to another feature of the invention, the drive cam is a double cam comprising different first and second operating surfaces, intended for contacting with the grip section and with the stop section, respectively, of the control slide.

Preferably, the first operating surface of the drive cam and the grip section of the control slide intended for cooperating to cause the swinging of the rocker arm are moved axially with respect to the second operating surface and the stop section intended for cooperating to cause the motor to stop.

According to a particularly interesting variant, the first and the second operating surfaces of the drive cam are virtually superposed.

BRIEF DESCRIPTION OF THE DRAWINGS

The attached drawings show, by way of a non-limiting example, a sequence of movements of the main components of the lock, assembled, and with a detail of some of these main components. In said drawings.

DETAILED DESCRIPTION OF THE DRAWINGS

The lock 1 depicted in FIGS. 1*a* to 3*a* is particularly intended for retaining the trunk door/lid of an automotive vehicle and comprises, in a known manner, a bolt 2, rotary about the axis 2*a* of rotation, and a latch 3, rotary about the axis 3*a* of rotation. The FIGS. 1*a* to 3*a* are a sequence of the various positions these parts of the lock 1 adopt in three different situations: when the lock is closed, and the bolt retains an anchor element integral with the trunk door/lid of the vehicle; when the lock is in the arrangement to adopt an open position; and when the lock is opened.

Figure 1A:
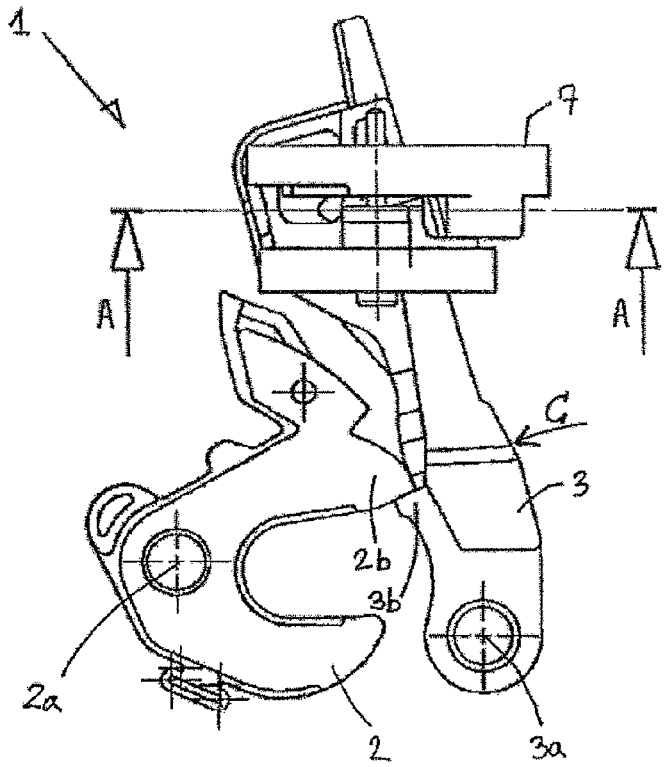
FIG. 1*a* is a plan view of the lock in which the bolt is in the closed position.
Figure 2A:
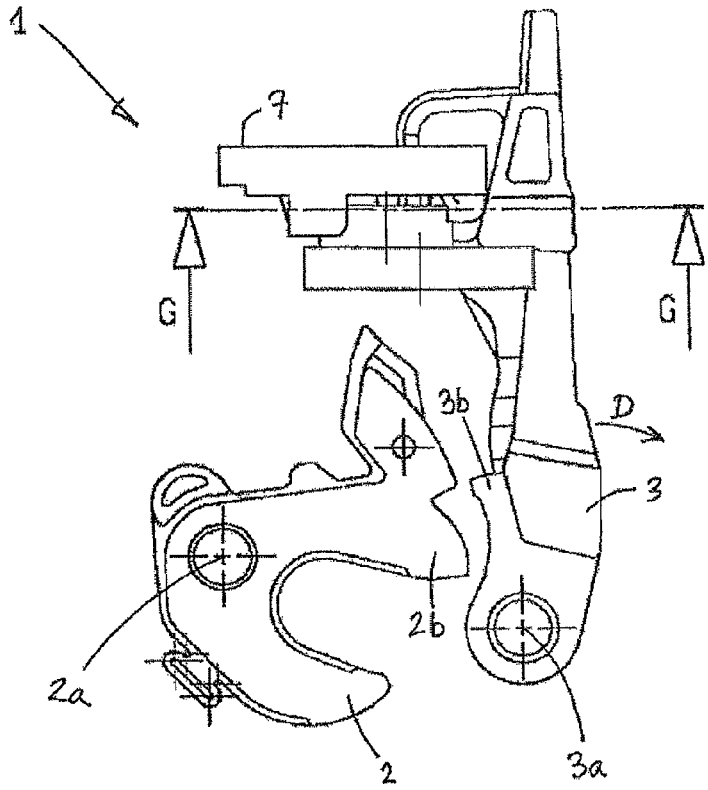
FIG. 2*a* is a plan view of the lock in which the bolt has been released.
Figure 3A:
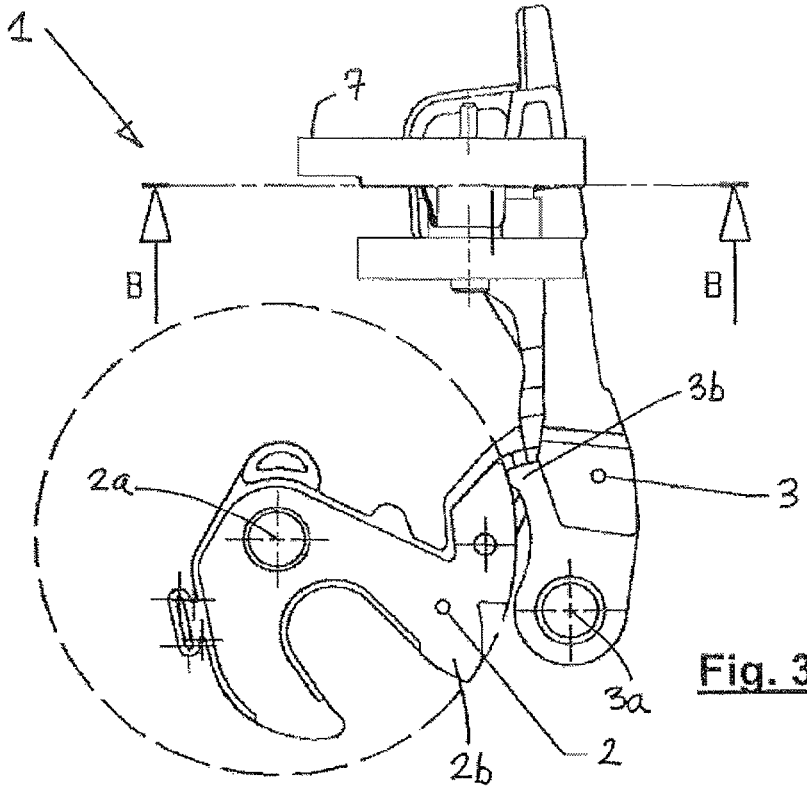
FIG. 3*a* is a plan view of the lock in which the bolt, after being released, is in the open position.

The bolt 2 is rotary between the closed position (A), depicted in FIG. 1*a*, in which it locks a closing anchor, not depicted, and the open position (B), depicted in FIG. 3*a*, in which it releases the mentioned anchor. The bolt 2 is subjected to forces by a first spring in the release direction, i.e., in the direction indicated by arrow B in FIG. 1*a*. In turn, the latch 3 is also rotary between at least the closed position, depicted in FIG. 1*a*, in which it retains the bolt 2 in the locking position, and another releasing position, depicted in FIG. 2*a*, in which it releases the mentioned bolt 2, the latch 3 being subjected to the action of a second spring thrusting it towards the closed position, i.e. in the direction of arrow C depicted in FIG. 1*a*.

In FIG. 1*a*, the bolt 2 is maintained in the closed position when its end 2*b* is supported against the catch 3*b*, blocking the rotation of the bolt 2 in the direction indicated by arrow B.

In FIG. 2*a*, the lock 1 has been depicted in a situation in which the latch 3 has been moved from the position it occupied in FIG. 1*a* and in which, overcoming the elastic force exerted thereupon by the second spring, it has been rotated about its axis 3*a* of rotation in the direction indicated by arrow D. In this situation, the catch 3*b* does not block the rotation of the bolt 2 which begins a rotation movement about its axis 2*a* of rotation by the effect of the first spring, in the direction towards the open position.

In FIG. 3*a*, the bolt 2 has reached the open position (B), and when a force is no longer exerted on the latch 3 in the direction indicated by arrow D of FIG. 2, the latter is supported against the outer surface of the bolt 2 by the action of the second spring. This is an intermediate position with respect to the ones depicted in FIG. 1*a* and FIG. 2*a*.

The lock 1 according to the invention furthermore comprises an electric motor 20 for driving a drive cam 4, according to a rotation direction about the axis 5 of rotation, and transmission means 6 suitable for transmitting the movement of the cam 4 to the latch 3, and moving it from its closed position, depicted in FIG. 1*a*, to its releasing position, depicted in FIG. 2*a*, when required by a user, and for allowing the latter to finally adopt the position depicted in FIG. 3. The drive means 6 are furthermore suitable so that when the bolt 2 again adopts its closed position, the operation of the drive cam 4, according to the same rotation direction, is again transmitted to the latch 3 to move it to its releasing position when it is again required by a user, and so on successfully.

Figure 1B:
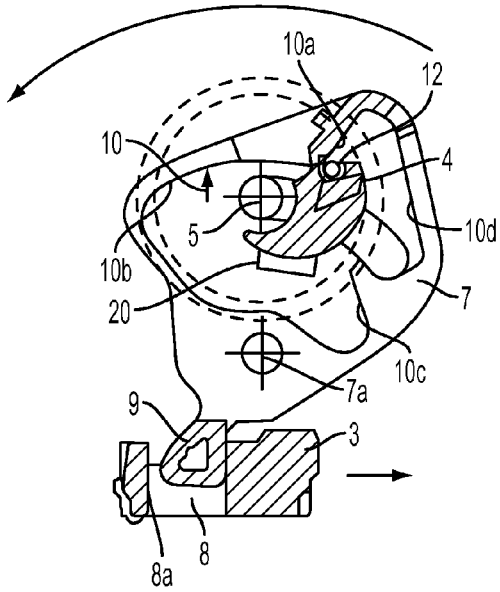
FIG. 1*b* is a section view according to plane AA of FIG. 1*a;*
Figure 2B:
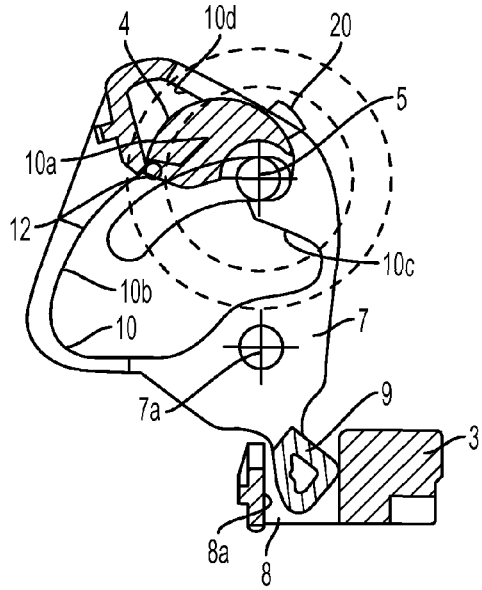
FIG. 2*b* is a section view according to plane GG of FIG. 2*a;*
Figure 3B:
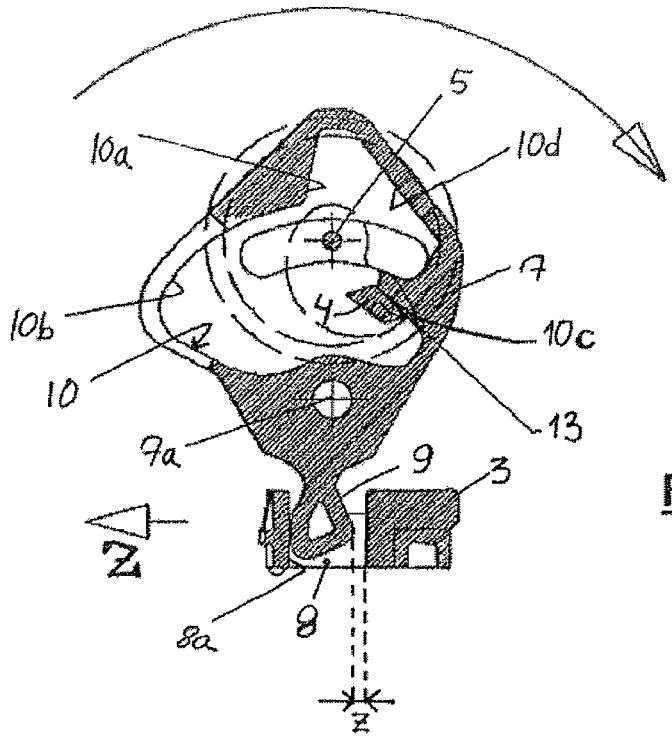
FIG. 3*b* is a section view according to plane BB of FIG. 3*a;*

As seen in FIGS. 1*b*, 2*b* and 3*b*, the transmission means 6 comprise a rocker arm 7, which can swing back and forth about the axis 7*a* between the two end positions depicted in FIGS. 1*b* and 2*b*, respectively, which rocker arm is provided with a peripheral extension 9, with an essentially triangular configuration, which is inserted with clearance in a groove 8 provided at the end of the latch 3. In the embodiment, the rocker arm 7 is inscribed in a plane perpendicular to the movement plane of the latch 3.

Figure 4:
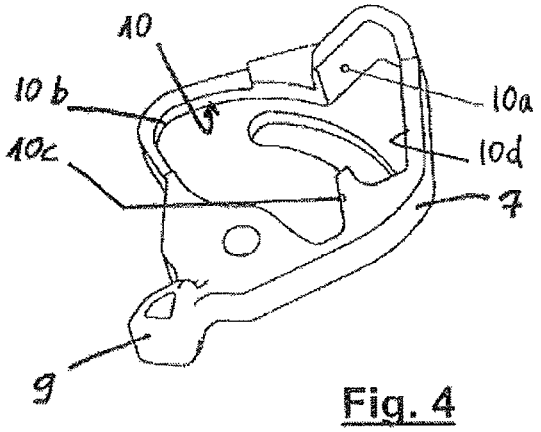
FIG. 4 is a detail view of the rocker arm.

The rocker arm 7, depicted in detail in FIG. 4, is provided with a control slide 10 through which the drive cam 4 slides. Said control slide 10 extends in a curved shape about the axis 5 of rotation of the drive cam 4, with variable radii, a grip section 10*a* with the drive cam 4 being determined, in which the movement of the cam 4 in counterclockwise direction causes the swinging of the rocker arm 7 in the direction indicated by the arrow of FIG. 1*b*; a first no-load section 10*b*, in which the drive cam 4 loses contact with the control slide 10 and rotates without driving the rocker arm 7; a stop section 10*c*, in which the resistance to the rotation of the drive cam 4 is offered which is suitable for generating a stop signal of the motor 20; and a second no-load section 10*d*, along which the drive cam 4 loses contact with the control slide 10 and rotates without driving the rocker arm 7 until again reaching the grip section 10*a*.

Figure 5:
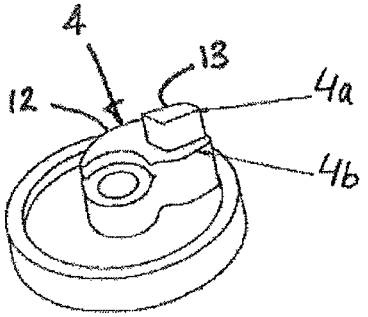
FIG. 5 is a detail view of the drive cam.

With respect to the drive cam 4, depicted in detail in FIG. 5, it is a double cam comprising different first and second operating surfaces 12 and 13, intended for contacting with the grip section 10*a* and with the stop section 10*c*, respectively, of the control slide 10. The first operating surface 12 of the drive cam 4 and the grip section 10*a* of the control slide 10, intended for cooperating to cause the swinging of the rocker arm 7, are inscribed in a plane perpendicular to the axis 5 of rotation of the cam 4 located in a position which is moved with respect to the plane in which the second operating surface 13 and the stop section 10*c*, intended for cooperating to cause the rotation of said cam 4 to stop, also perpendicular to the axis 5 of rotation of the cam 4, are inscribed.

Therefore, the operation of the lock 1 is described below:

With the lock 1 being closed, when the motor 20 is actuated, the cam 4 rotates in clockwise direction until reaching the position depicted in FIG. 1*a*. From this position, the rotation of the cam 4 causes, by contact between the operating surface 12 of the cam 4 and the grip section 10*a* of the slide 10 of the rocker arm 7, the rotation of the latter in the direction indicated by the arrow of FIG. 1*b*. The rotation of the rocker arm 7 in turn causes, by thrusting of its peripheral extension 9, the rotation of the latch 3 from its closed position to the releasing position depicted in FIGS. 2*a* and 2*b*. The bolt 2 automatically rotates until reaching its open position (B) depicted in FIGS. 3*a* and 3*b*.

Once the latch 3 has reached its releasing position, the operating surface 12 of the cam 4 loses contact with the slide 10 when beginning in the no-load section 10*b*, whereby the rocker arm 7 remains subject to the thrust received by the latch 3 which, driven by the second spring, is applied against the bolt 2 as depicted in FIGS. 3*a* and 3*b*. The drive cam 4 continues to rotate in counterclockwise direction until the operating surface 13 thereof runs into the stop section 10*c* of the control slide 10. This is the position in which the cam 4 has been depicted in FIGS. 3*a* and 3*b*.

In the position depicted in FIGS. 3*a* and 3*b*, rotation of the cam 4 is prevented by the operating surface running into the stop section 10*c* of the slide 10. In this moment, the motor 20 is stopped either because the heating of a thermistor generates a stop signal or because a predetermined time has elapsed from the start of its operation, the components of the lock 1 being, in any case, in the position depicted in FIGS. 3*a* and 3*b*. It must be noted that, in the embodiment depicted, the force exerted by the operating surface 13 of the cam 4 against the stop section 10*c* of the slide 10 of the rocker arm, due to the angle of incidence of the contact surfaces, causes a slight backwards movement of the rocker arm 7 in clockwise direction, such that the peripheral extension 9 is supported against the end 8*a* of the groove 8 of the latch 3. In FIG. 3*a*, the clearance existing between this peripheral extension 9 and the ends of the groove 8 has been indicated using reference z.

With the lock being in the open position, when the trunk door/lid of the vehicle is closed, the bolt 2 is forced to rotate by the closing anchor, in counterclockwise direction, until reaching the position depicted in FIG. 1. The change of position of the bolt 2 in turn causes the latch 3 to also change its position and, forced by the second spring, to rotate about its axis 3*a* of rotation to the position it occupies in FIG. 1*a*. As a consequence of the rotation of the latch 3, the end provided with the groove 8 moves tangentially a distance Z greater than the clearance z existing between the groove 8 and the peripheral extension 9 of the rocker arm 7, therefore the latter is forced to rotate, in clockwise direction, to the position depicted in FIG. 1*a*. When the rocker arm 7 changes its position with respect to the drive cam 4, and especially with respect to its operating surface 13, the cam 4 can be driven again, in the same rotation direction and without opposition of the rocker arm 7, until reaching the grip section 10*a*, to again open the lock 1.

In fact, in the event that the lock 1 must again be opened, the motor 20 is actuated and the drive cam 4 rotates in clockwise direction along the second no-load section 10*d* of the control slide 10 of the rocker arm 7 and is moved from the position it occupies in FIG. 3*a* to the position depicted in FIG. 1*a*, after which time the same movements previously described here are triggered.

The invention claimed is:

1. A motor-driven lock (1) with a rotary bolt, comprising a bolt (2) rotary between at least one closed position (A), in which the bolt locks a closing anchor, and another open position (B), which releases the closing anchor, the bolt subject to forces by a spring in the release direction, and a latch (3) also rotary between a closed position, in which the latch retains the bolt in the locking position, and another releasing position, in which the latch releases the bolt, the latch being subjected to the action of a second spring thrusting the latch towards the closed position, the lock (1) furthermore comprising a motor-driven drive cam (4), which rotates about an axis (5), and a transmission means (6) suitable for moving the latch (3), from the closed position to its releasing position, the transmission means (6) comprise a rocker arm (7), configured to swing back and forth, between two end positions, provided with a peripheral extension (9) loosely coupled to the end of the latch (3), the rocker arm (7) comprising an aperture having a periphery that includes a control slide surface (10) extending in a curved shape about the axis (5) of rotation of the drive cam (4), with variable radii, the drive cam being located within the aperture, and a grip section (10*a*) with the drive cam (4) being determined, in which the movement of the drive cam (4) causes the swinging of the rocker arm (7) in a first direction and, by thrusting of the peripheral extension (9), the rotation of the latch (3) from the closed position to the releasing position, and hence that of the bolt to the open position;

a no-load section (10*b*), in which the drive cam (4) loses contact and rotates without driving the rocker arm (7), the rocker arm being subject to the thrust received by the latch (3) which is driven by the second spring and is applied against the bolt (2); and a stop section (10*c*), in which resistance to the rotation of the drive cam (4) is offered which is suitable for generating a stop signal of the motor, the contours of the bolt (2) and of the latch (3) as well as the clearance (z) between the peripheral extension (9) of the rocker arm (7) and the slide (8) of the latch (3) being configured such that, when the bolt (2) is forced to adopt the closed position, when the latch (3) is rotated in a direction towards said bolt (2) by the action of the second spring, the latch (3) thrusts the peripheral extension (9) of the rocker arm (7), forcing the peripheral extension to swing in a direction opposite the first direction and to change position with respect to the drive cam (4), such that the drive cam (4) can be driven again, in the same rotation direction and without opposition of the rocker arm (7), until reaching the grip section (10*a*), to again open the lock (1).

2. The lock (1) according to claim 1, wherein the peripheral extension (9) of the rocker arm (7) is inserted with clearance in a groove (8) provided in the end of the latch (3).

3. The lock (1) according to claim 2, wherein, when the bolt (2) adopts the closed position in the angular movement of the latch (3) about the axis of rotation of the latch by the action of a second spring, the portion of the latch provided with the groove (8) is moved a length (Z) greater than the clearance (z) existing between the peripheral extension (9) of the rocker arm (7) and the groove (8).

4. The lock (1) according to claim 1, wherein the drive cam (4) is a double cam comprising different first and second operating surfaces (12, 13), that are configured to respectively contact with the grip section (10*a*) and with the stop section (10*c*) of the control slide surface (10).

5. The lock (1) according to claim 4, wherein the first operating surface (12) of the drive cam (4) and the grip section (10*a*) of the control slide surface (10), configured to cooperate to cause the swinging of the rocker arm (7), are moved axially with respect to the second operating surface (13) and the stop section (10*c*), to cause the motor to stop.

6. The lock (1) according to claim 5, wherein the first and the second operating surfaces (12, 13) of the drive cam (4) are superposed.

7. The lock (1) according to claim 2, wherein the drive cam (4) is a double cam comprising different first and second operating surfaces (12, 13), that are configured to respectively contact with the grip section (10*a*) and with the stop section (10*c*) of the control slide surface (10).

8. The lock (1) according to claim 3, wherein the drive cam (4) is a double cam comprising different first and second operating surfaces (12, 13), that are configured to respectively contact with the grip section (10*a*) and with the stop section (10*c*) of the control slide surface (10).

9. The lock according to claim 1, configured for use with rear doors, hatches or trunks of automotive vehicles.

10. The lock according to claim 1, wherein the rocker arm (7) is configured to swing back and forth between two end positions relative to the motor drive cam (4).

11. A motor-driven lock (1) comprising a bolt (2) rotary means to lock a closing anchor, and a latch means (3) for retaining the bolt means in the locking position, and a releasing position in which the latch (3) releases the bolt means, the lock (1) further comprising motor-driven drive cam means (4), for rotating about an axis (5), a transmission means (6) for moving the latch (3) from the closed position to its releasing position, a rocker arm means (7) configured to swing back and forth between two end positions with a peripheral extension (9) loosely coupled to the end of the latch (3), including an aperture having a periphery that includes a control slide surface (10) extending in a curved shape with a grip section (10*a*), the cam means being located within the aperture, wherein the movement of the cam means (4) causes the swinging of the rocker arm (7) in a first direction and, the thrusting of the peripheral extension (9) causes the rotation of the latch (3) from the closed position to the releasing position and the bolt to the open position;

a no-load section (10*b*) means for the cam means (4) to rotate without driving the rocker arm (7); and a stop section means (10*c*), for generating a stop signal of the motor, wherein the bolt means, (2) the latch, (3) the clearance (z) between the peripheral extension (9) of the rocker arm (7) and the slide (8) of the latch (3) are configured such that, when the bolt means (2) adopts the closed position, and the latch (3) is rotated in a direction towards said bolt means, (2) the latch (3) thrusts the peripheral extension (9) of the rocker arm (7), to swing in a direction opposite the first direction and to change position with respect to the cam means (4), so that the cam means (4) can be driven again in the same rotational direction without opposition of the rocker arm (7), until reaching the grip section (10*a*), to again open the lock (1).

12. The lock according to claim 11, wherein the rocker arm (7) is configured to swing back and forth between two end positions relative to the cam means (4).

13. A motor-driven lock (1) comprising a bolt (2) rotary between at least one closed position (A), one open position (B), and another releasing position, the lock (1) further comprising a motor-driven drive cam (4), which rotates about an axis (5), a transmission means (6) for moving the latch (3), a rocker arm (7) comprising an aperture and the drive cam being located within the aperture, configured to swing back and forth, with a peripheral extension (9) loosely coupled to the end of the latch (3), and a control slide surface (10) formed on a periphery of the aperture extending in a curved shape with a grip section (10*a*) in which the movement of the drive cam (4) causes the swinging of the rocker arm (7) in a first direction and, the rotation of the latch (3) from the closed position to the releasing position, and the bolt to the open position;

a no-load section (10*b*), in which the drive cam (4) rotates without driving the rocker arm (7);

a stop section (10*c*), in which resistance to the rotation of the drive cam (4) is offered to generate a stop signal of the motor, wherein the bolt, (2) the latch, (3) and the clearance (z) between the peripheral extension (9) of the rocker arm (7) and the slide (8) of the latch (3) are configured such that, when the bolt (2) is in the closed position, and the latch (3) is rotated in a direction towards said bolt (2) the latch (3) thrusts the peripheral extension (9) of the rocker arm (7), to swing in a direction opposite the first direction and to change position with respect to the drive cam (4), such that the drive cam (4) can be driven again, in the same rotation direction and without opposition of the rocker arm (7), until reaching the grip section (10*a*), to again open the lock (1).

14. The lock according to claim 13, wherein the rocker arm (7) is configured to swing back and forth between two end positions relative to the drive cam (4).

* * * * *